US005868298A

United States Patent [19]

Holmen et al.

[11] Patent Number: 5,868,298

[45] Date of Patent: Feb. 9, 1999

[54] METHOD FOR MANUFACTURING SHELLS

[75] Inventors: Rolf Martin Holmen; Vegard Sande, both of Raufoss, Norway

[73] Assignee: Raufoss Technology AS, Raufoss, Norway

[21] Appl. No.: 746,309

[22] Filed: Nov. 8, 1996

[30] Foreign Application Priority Data

Nov. 21, 1995 [NO] Norway ..... 954707

[51] Int. Cl.[6] ..... B23K 20/12; B21K 21/06

[52] U.S. Cl. ..... 228/114.5; 228/232; 148/527; 29/1.2

[58] Field of Search ..... 228/114.5, 232; 148/527; 29/1.2

[56] References Cited

U.S. PATENT DOCUMENTS 471,129 3/1892 Loveland et al. ..... 29/1.2

2,353,693 7/1944 Church ..... 29/1.2

FOREIGN PATENT DOCUMENTS 270771 5/1970 U.S.S.R. ..... 148/529

468734 4/1975 U.S.S.R. ..... 228/114.5

*Primary Examiner*—Patrick Ryan
*Assistant Examiner*—Jeffrey T. Knapp
*Attorney, Agent, or Firm*—Larson & Taylor

[57] ABSTRACT

The present invention relates to a method for manufacturing shells, wherein a belt is attached to the outer surface of the shell by friction welding. The method is particularly favorable for welding bands to thin-walled shells. In the method, prior to the welding process, the shell is hardened and/or tempered for optimizing its properties during use and, after hardening and/or tempering, the shell receives the belt by friction welding, during which the temperature of the shell is kept at a level which does not reduce the qualities of the shell to a substantial degree.

10 Claims, 5 Drawing Sheets

METHOD FOR MANUFACTURING SHELLS

FIELD OF THE INVENTION

The present application relates to a method for manufacturing shells, on which shells there on the outer surface of the shell body is attached a belt by friction welding.

BACKGROUND OF THE INVENTION

The present invention relates to drive band technology, and more particularly to methods for attaching a so-called belt, also called guiding band or drive band, to a shell, for example an artillery shell. The task of the shell or granade is to transfer a payload, for example sub-ammunition units, or being a charge carrier.

The belt is attached to the rear part of the shell, the object thereof being to seal the driving gases and convert the spiral twisting of the barrel grooving to a rotating and thereby stabilizing trajectory of said shell.

It is common that the belt is manufactured from a softer material than that of the shell, substantially because the wearing of the gun barrel must be kept at a lowest possible level.

PRIOR ART

It is previously known to attach such belts to a shell or granade by pressing and/or shrinking connections, weld deposit as well as electronic beam welding. For example in NO patent application 94.3097 (Rheinmetall GmbH) there is disclosed attachment of bands of pure iron by electric cover gas welding (MIG-welding).

From NO patent application No. 80.0640 (Aktiebolaget Bofors) corresponding to SE 441305 there is known to friction weld the driving band of the granade to the shell body. Such a friction welding can take place by rotating a granade shell of steel whilst a stationary band of appropriate material is pressed against the place of welding, whereafter at appropriate heat development and welding consistency the rotation is stopped and the band is further pressed in position on the shell.

SUMMARY OF THE INVENTION

The development in the artillery field including longer gun barrels and increasing discharge velocity and the requirement that the individual shell types are to be especially thin-walled, has created a need for novel attachment methods for said belts.

Experiments have been carried out with friction welding of the type mentioned above, but these experiments have not succeeded because the hardening respectively the heat treatment of the granade shell took place after the belts had been attached to the shell or granade, respectively, by friction welding. This post-hardening involved an unfavourable metallurgical influence on the "setting" of the belt, which could not bear the load in the gun barrel during launching.

The object of the present invention is to provide a method for manufacturing shells which on the one hand can be used specifically for thin-walled projectiles, and which on the other hand is not hampered with the disadvantages involved in post-hardening.

These objects are achieved in a method of the type as stated in the preamble, which according to the invention is characterized in that the shell prior to the welding process is hardened and/or tempered for optimum use properties, and that the shell after hardening and/or tempering receives the belt by friction welding, the temperature of the shell or granade at the same time being kept at a level which does not to a substantial degree reduce the material qualities of said shell.

Further features and advantages of the present method will appear from the following description taken in connection with the appended drawings, as well as from the attached patent claims.

BRIEF DISCLOSURE OF THE DRAWINGS

DESCRIPTION OF EMBODIMENTS

Figure 1A:
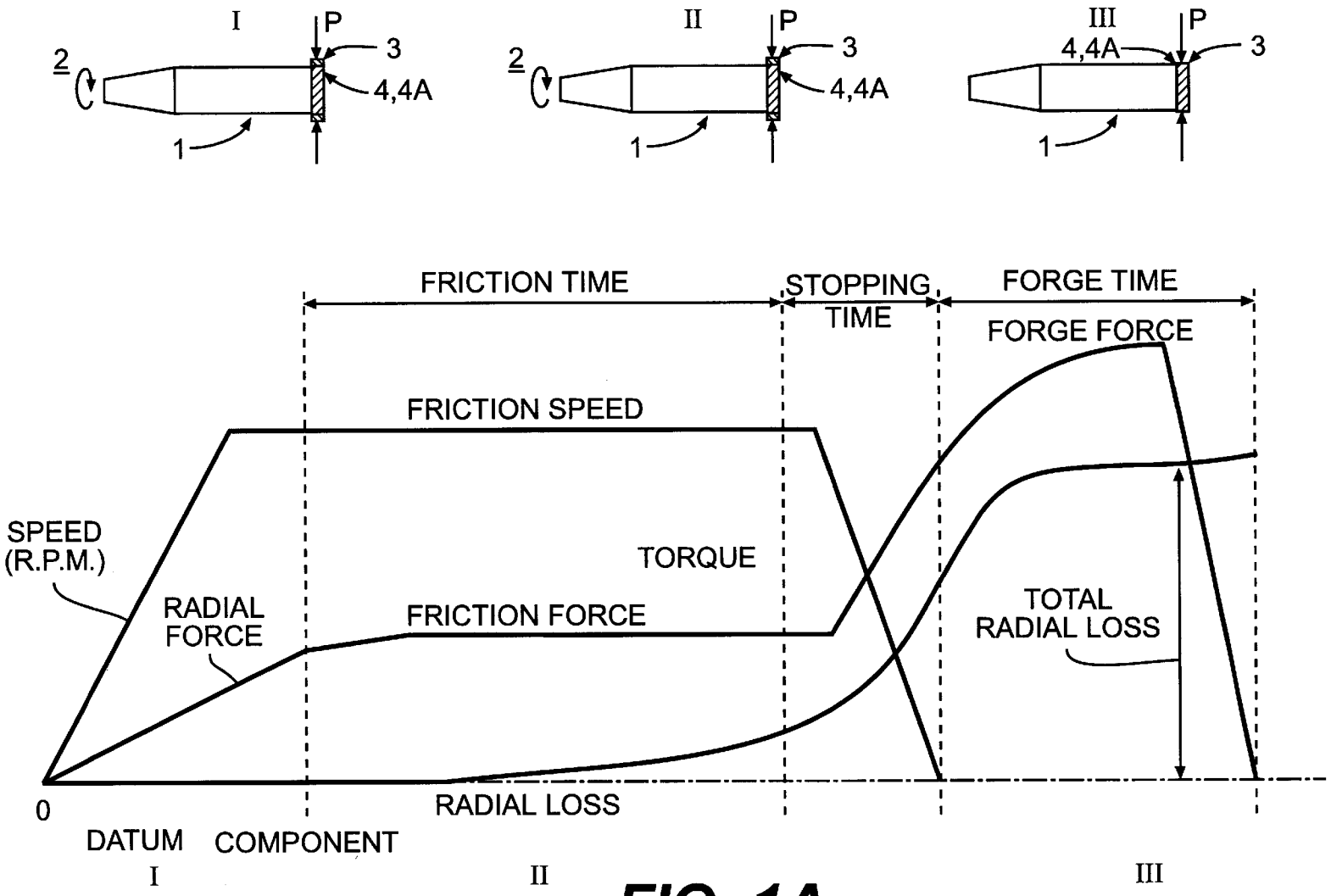
FIG. 1A illustrates at the top three different stages in a friction welding process, and at the bottom a corresponding curve diagram over parametres in question.

In FIG. 1A there is schematically illustrated how a method according to the invention can be carried out, the upper part of the Figure illustrating three different steps, I, II and III, respectively, of the welding process. The process starts by clamping a granade shell 1, preferably of steel, in an appropriate welding apparatus, which apparatus is indicated by reference numeral 10 in FIG. 1B, and comprises appropriate driving means 11 for rotating said shell 1, as this is indicated by the arrow 2 in FIG. 1A.

Figure 1B:
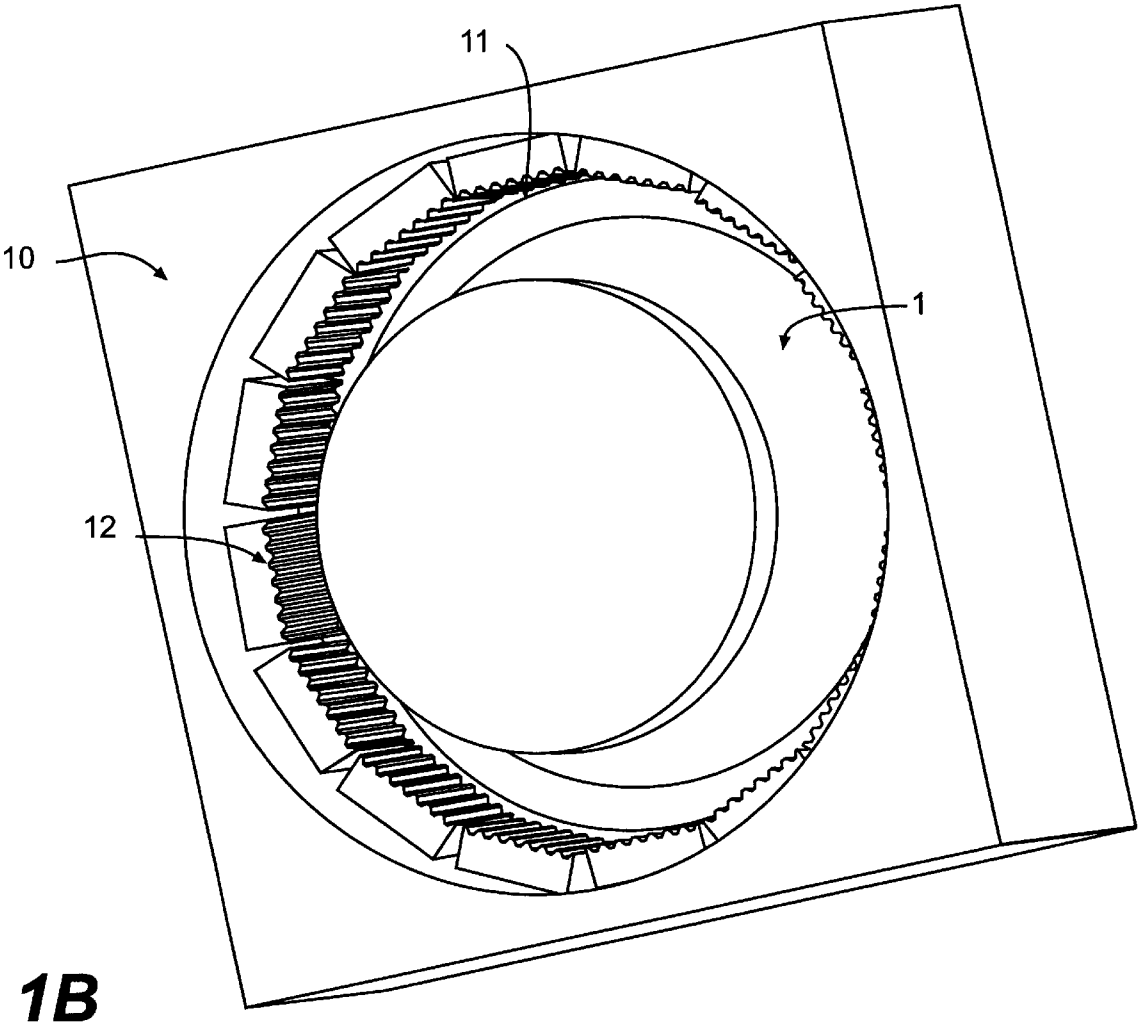
FIG. 1B is a perspective view of parts of a friction welding machine, especially in the area of the press jaws being used for impressing the guiding band.

After the shell 1 during step I has gained an appropriate velocity, for example a peripheral velocity of approximately 2.5 m/sec, a stationary band 3 will by appropriate clamping jaws 12, see FIG. 1A and FIG. 1B, be pressed with a force P against the portion of the granade shell 1 on which the band 3 is to be applied. During the welding process itself, i.e. mainly during step II in FIG. 1A, there will thus between the shell 1 and the band 3 be developed a specifically thin he at influenced zone 4A, as this particularly appears from FIGS. 2 and 3, and which will be further discussed in the following.

To the right of FIG. 1A, at step III, there is illustrated that after appropriate heat development in the zone 4A, and by appropriate welding consistency of shell and band, the rotation of said shell 1 will be halted, whereafter the band 3 is further pressed in position on the shell 1.

What is unique in the method according to the invention is that the shell prior to welding of the band is hardened to optimum use properties, and that the shell after said hardening receives the belt by friction welding. During the welding process itself, i.e. during steps II and III illustrated in FIG. 1A, the temperature of the granade shell is kept at a lowest possible level, for example by water cooled tool parts, especially the clamping jaws 12 and an inner mandrel in the shell, such that the material qualities of the shell is not reduced to any substantial degree.

The method is particularly advantageous by using shells having a wall thickness in the range of approx. 2 mm to 7.5 mm, and more particularly, 4 mm, but is to be understood that the process also can be used in connection with a series of shell wall thicknesses. Advantageously, the method may be performed by using shell bodies which during the manufacturing stage of welding have a thickness in the range of 3 mm or more.

The pre-hardening may appropriately take place at a temperature of approx. 850° C. at which the steel has a pure austenite phase, whereafter the material is cooled relatively fast to approx. 720° C. to the martensittic phase thereof, which will render a somewhat larger volume, whereafter the material is appropriately cooled to room temperature.

Appropriately, there may be used shells of steel, and more particularly heat treatment steel.

The welding of the guiding band can be carried out on a cylindrical outer surface, which requires less preparatory work thereof, and which will nok render a further reduction of the wall thickness. Besides, a cylindrical smooth outer shell body will present greater versatilities for the designer of the shell. Alternatively, the shell may, prior to the hardening, be equipped with an appropriate circumferential recess 4A in the area to which the band is to be attached.

Figure 3:
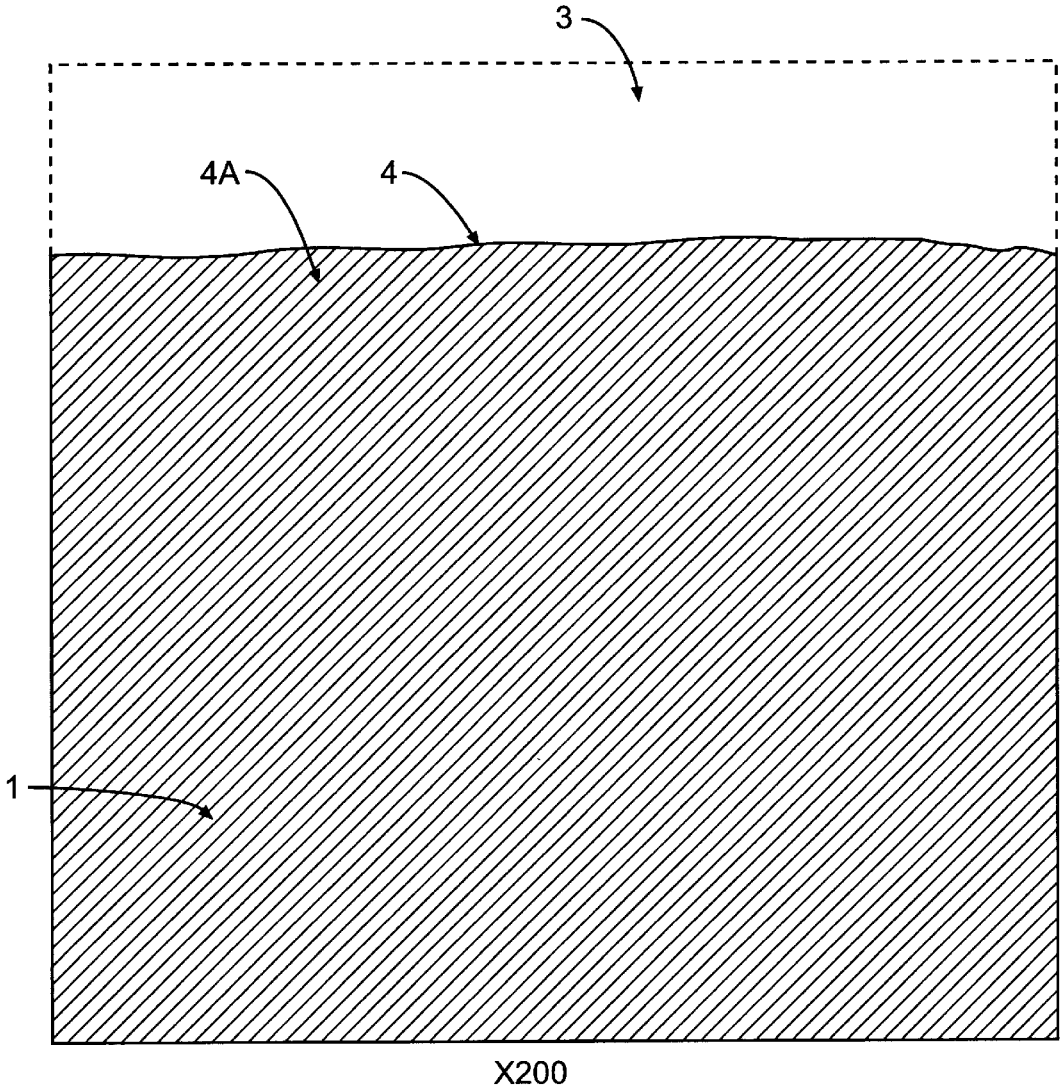
FIG. 3 is a micro-section through band and heat influenced zone, enlarged 200 times.

In FIG. 3 there is illustrated a micro-section through a portion of a shell 1 having a band 3 welded thereto, 200 times enlarged, and it is here seen that the welding layer 4 itself is relatively straight, and having substantially the same structure as the material of the rest of the shell 1, which involves that the material qualities of the shell is so to say unaltered.

Such a band 3 may appropriately be made of for example brass, Cu-Ni alloys, Cu-Al alloys, copper, iron, and similar.

Preferably, the band may be provided with main dimensions comprising a width of approx. 37 mm, up to for example approx. 50 mm, and more particularly 40 mm and a thickness of approx. 3 mm.

Referring again to FIG. 1A, it is here illustrated schematically a curve diagram of the course of the process in a friction welding process, and it is to be understood that an appropriate friction welding time will be below 20 seconds, at the same time as the welding of the band takes place at a relative velocity between shell and band of approximately 4 m/sec.

In the welding interval the friction force will have a certain magnitude, whereas in the halting interval, see step III in FIG. 1A, the force P on the band will increase into the terminating period or forging period.

During the friction welding the temperature of the surface of the band may be in the range of approx. 100° C., below the melting temperature of the selected guiding band material, which appropriately may vary between 80°–1200° C.

Figure 2:
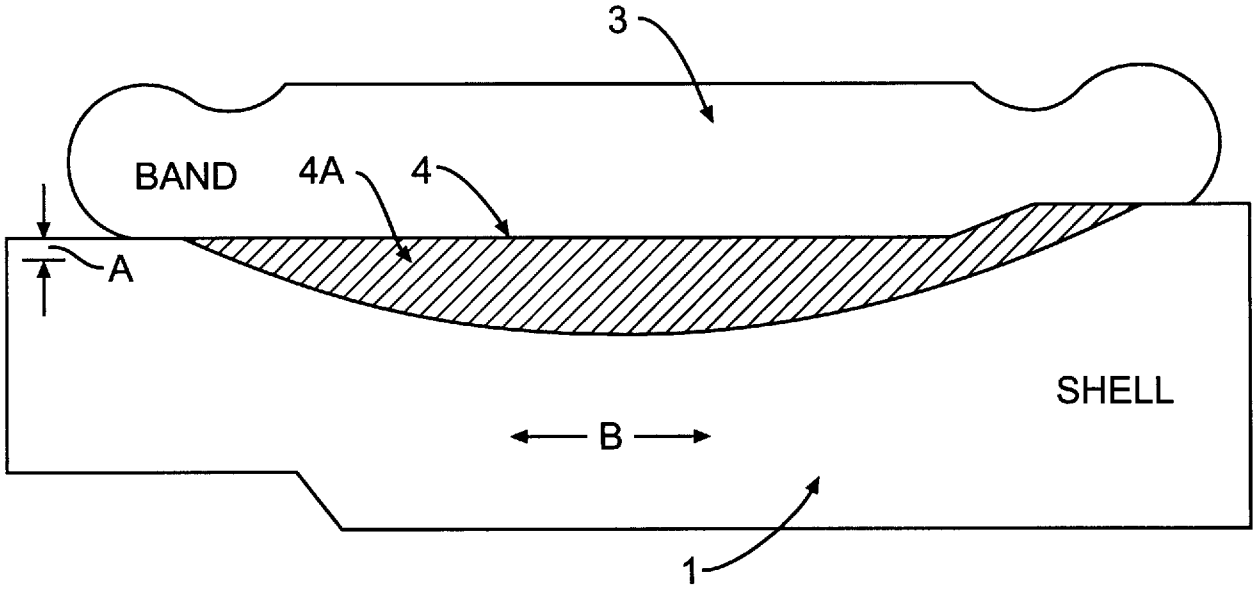
FIG. 2 is a schematic section through a shell wall and a welded band having a heat influenced zone therebetween.

By various means the temperature of the granade shell may during the execution of the welding process be regulated so as to be high enough in the welding area, but be kept as low as possible in the remaining shell. The intense heat development will then be restricted to the thin welding area 4A, namely to the outer layer of the shell 1, such that the remaining shell will conserve its original material structure, see FIGS. 2 and 3. The heat influenced zone, as shown in FIG. 2, has a thickness A of greater than 0.5 mm and a width B of approximately 20 mm. As previously discussed in connection with FIG. 3, the material in the heat influenced zone 4A itself will neither be reduced to a substantial degree in relation to the hardened or tempered shell material as such.

Even in connection with very thin-walled granade shells the heat development can thereby be kept at a level which does not influence the qualities of the granade shell beyond what is acceptable. The method can be used for attaching a band made of any appropriate material, i.e. having an appropriate ductility in relation to the shell material.

Figure 4:
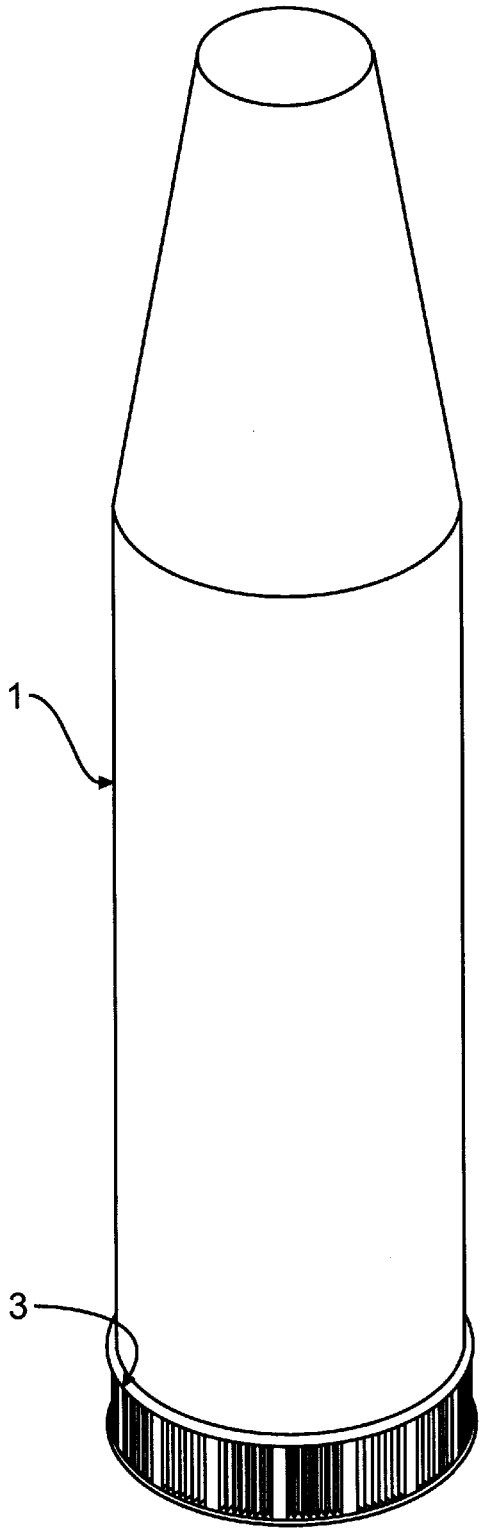
FIG. 4 illustrates examples of a 155 mm shell with friction welded driving bands.

In FIG. 4 there is illustrated a 155 mm shell 1 with friction welded driving bands 3, provided in accordance with the present invention which is specifically favourable in connection with thin-walled granade shells.

Thin-walled hardened shells will render a larger inner space for small charges, i.e. the thinner the material the larger the payload volume.

We claim:

1. A Method for manufacturing shells, wherein on the outer surface of the shell body is attached a belt by friction welding, said method characterized in that the shell, prior to the welding process, is hardened and/or tempered for optimum use properties, and that the shell, after hardening and/or tempering, receives the belt by friction welding, the temperature of the shell at the same time being kept at a level which does not to a substantial degree reduce the material qualities of said shell.

2. Method as claimed in claim 1, characterized by using shell bodies which upon completion of manufacturing have a wall thickness in the range of 2 mm to 7.5 mm.

3. Method as claimed in claim 1, characterized by using shell bodies which during the manufacturing stage of welding have a thickness in the range of 3 mm and more.

4. Method as claimed in claim 1, characterized by using shells made of steel, where in said steel is optionally heat treated steel.

5. Method as claimed in claim 1, characterized in that the welding of the band (3) takes place at a relative velocity between shell (1) and band of approximately 4 m/sec.

6. Method as claimed in claim 1, characterized in that said welding takes place at a temperature of approximately 100° C. below the melting temperature of said band.

7. Method as claimed in any of the preceding claims, characterized in that the shell, the driving means and the clamping jaws are subjected to cooling during the welding process, such that the temperature increase necessary for the welding is concentrated in narrow layers of the shell body surfaces to be welded.

8. Method as claimed in claim 1 characterized by using as the belt (3) a band (3) to be welded to said shell (1).

9. Method as claimed in claim 8, characterized in that said band is made with main dimensions width approximately 40 mm, thickness approximately 3 mm.

10. Method as claimed in claim 5, wherein said band (3) is comprised of a material chosen from the group consisting of: brass, Cu-Ni alloys, Cu-Al alloys, copper, and iron.

* * * * *